US008127385B1

(12) United States Patent
Goutevenier

(10) Patent No.: US 8,127,385 B1
(45) Date of Patent: Mar. 6, 2012

(54) INFANT HEAD REST AND ANGULAR SUPPORT PILLOW

(76) Inventor: Elizabeth Goutevenier, Port Washington, NY (US)

( * ) Notice: Subject to any disclaimer, the term of this patent is extended or adjusted under 35 U.S.C. 154(b) by 0 days.

(21) Appl. No.: 12/238,759

(22) Filed: Sep. 26, 2008

(51) Int. Cl.
*A47D 15/00* (2006.01)

(52) U.S. Cl. ..... 5/655; 5/633

(58) Field of Classification Search ..... 5/655, 630, 5/632–633, 494; 128/875–876
See application file for complete search history.

(56) References Cited

U.S. PATENT DOCUMENTS 1,368,582 A * 2/1921 Stevens ..... 5/494
4,989,286 A * 2/1991 Tucker ..... 5/482
5,439,008 A * 8/1995 Bowman ..... 128/875
* cited by examiner

*Primary Examiner* — Fredrick Conley
(74) *Attorney, Agent, or Firm* — Michael I. Kroll

(57) ABSTRACT

A method for securing an infant at a gently angled upright position employs an infant bedding system having a generally wedge shaped angular pillow; an angled pillow cover adapted to extend the angular pillow at an angle similar to that of the angular pillow, an incline from 20 to 40 degrees; a headring pillow; hook and loop fasteners for removably attaching the headring pillow to the angled pillow cover; a cloth wrap adapted to wrap around an infant; hook and loop fasteners for removably attaching the cloth wrap to the angled pillow cover; and hook and loop fasteners for securing said cloth wrap around the waist of an infant. The infant is placed on the infant bedding system with the infant's head resting on the headring pillow and the infant's body overlying the cloth wrap, the cloth wrap is folded up between the infant's legs to the infant's waist, and the cloth wrap is secured around the waist of the infant.

22 Claims, 10 Drawing Sheets

INFANT HEAD REST AND ANGULAR SUPPORT PILLOW

BACKGROUND OF THE INVENTION

1. Field of the Invention

The present invention relates generally to infant bedding and, more specifically, an angular pillow that holds a child in a secured position having a removable head ring pillow that attaches to the angular pillow by means of hook and loop fasteners with a removable/washable pillow cover. A sleeping bag/blanket is provided and attaches to the lower portion of the head ring, also by means of hook and loop fasteners and is secured in an open or closed position by means of hook and loop fasteners. Hook and loop fasteners strips attached cloth wrap in which a baby is placed upon said pillow and wrap in a gently angled position (20°-40°). The child is then wrapped about the waist with the attached cloth having Hook and loop fasteners to secure the child to said pillow. Hook and loop fasteners crib attachments are provided to secure the device to a child's crib. The child can then rest or digest after eating without suffering from acid reflux or flowing back of foods. Also, the child can rest more comfortably when suffering from upper respiratory, head and sinus congestion.

2. Description of the Prior Art

There are other infant bedding devices designed for holding a baby's head and body at an upward angle. Typical of these is U.S. Pat. No. 4,862,535 issued to Roberts on Sep. 5, 1989.

Another patent was issued to Tucker on Feb. 5, 1991 as U.S. Pat. No. 4,989,286. Yet another U.S. Pat. No. 5,014,376 was issued to Doran et al. on May 14, 1991 and still yet another was issued on Oct. 25, 1994 to Tucker as U.S. Reissue Pat. No. RE 34,763.

Another patent was issued to Klingemann et al. on Sep. 1, 1998 as U.S. Pat. No. 5,800,368. Yet another U.S. Pat. No. 6,922,861 was issued to Mathis on Aug. 2, 2005. Another was issued to Elkin et al. on Aug. 23, 2005 as U.S. Pat. No. 6,931,683 and still yet another was published on Sep. 15, 2005, to Elkin et al. as U.S. Patent Application No. US2005/0198739.

Another patent was issued to Goutevenier-Reyher on Feb. 28, 2006 as U.S. Pat. No. 7,003,831. Yet another International Patent Application No. WO95/17118 was published to Bowman on Jun. 29, 1995. Another patent was issued to Aziz on Aug. 15, 1990 as British Patent No. GB2227930.

U.S. Pat. No. 4,862,535

Inventor: Kaye H. Roberts

Issued: Sep. 5, 1989

An anti-reflux support system for an infant is disclosed comprising a wedge-shaped support pillow having an inclined infant-supporting surface, an infant torso-encircling sling attachable to the infant-supporting surface of the support pillow, and fasteners carried by at least one of the pillow or the slings for securing the sling on the infant-supporting surface in any one of a plurality of positions. The support pillow includes internal spaced, vertically-oriented support baffles extending between the infant-supporting surface and the bottom surface, and a loose, particulate filler material. The filler material cooperates with the support baffles to impart the wedge-shape to the pillow and to permit the infant-supporting surface to be deformed concavely, and thus conform to the shape of the infant's torso, when the infant is placed on the infant-supporting surface. The torso-encircling sling includes a single elongated sheet of soft, preferably absorbent, material which is foldable into a diaper-like garment securable around the lower part of the infant's torso. Fasteners carried by the sling facilitate securing together facing sides of the folded sheet.

U.S. Pat. No. 4,989,282

Inventor: Ann Tucker

Issued: Feb. 5, 1991

A bedding article for supporting infants with gastroesophageal reflux condition comprising a band of bedding material defining at least a partial covering for the crib mattress and forming a tensile load carrying connection therewith and a infant support sling connected to the band of the bedding material.

U.S. Pat. No. 5,014,376

Inventor: Cheryl C. Doran et al.

Issued: May 14, 1991

An apparatus for supporting and securely holding an infant is disclosed. In its preferred embodiment, the apparatus includes a wedge-shaped resilient support member having an inclined surface for supporting an infant thereon. A blanket is provided which is releasably attachable to the support member and which can be wrapped around the infant when positioned on the inclined surface of the support member. Preferably, the blanket can be releasably attached to the bottom of the support member and wrapped around the support member and the infant to provide the comfort, warmth and security similar to that which an infant would experience when held in someone's arms. A music box may be affixed to or mounted within the support member to play music such as a lullaby and the like.

U.S. Reissued Pat. No. RE 34,763

Inventor: Ann Tucker

Issued: Oct. 25, 1994

A bedding article for supporting infants with gastroesophageal reflux condition comprising a band of bedding material defining at least a partial covering for the crib mattress and forming a tensile load carrying connection therewith and a infant support sling connected to the band of the bedding material.

U.S. Pat. No. 5,800,368

Inventor: Michael E. Klingemann

Issued Sep. 1, 1998

A sleeping device for infants having trachea malacia and/or gastro-intestinal reflux including a foam wedge having a cut-out formed therein. A plastic casing is dimensioned for securement over the foam wedge. A fabric cover is dimensioned for removable coupling over the plastic casing and the foam wedge. The fabric cover includes a pad for positioning within the cutout of the foam wedge.

U.S. Pat. No. 6,922,861

Inventor: Michelle L. Mathis

Issued: Aug. 2, 2005

Disclosed is a device for holding and supporting an infant, which consists of a base including a proximal extremity, an opposing distal extremity, and an edge therebetween. The base has an inclined surface extends from the proximal extremity to the edge, and a generally horizontal surface extends from the edge to the distal extremity. A body-supporting harness assembly, located atop the inclined surface, is attached to the base and is movable between a first body supporting position away from the general horizontal surface and a second position toward the generally horizontal surface.

U.S. Pat. No. 6,931,683

Inventor: Robynne R. Elkin et al.

Issued: Aug. 23, 2005

A reflux wedge for supporting an infant suffering from acid reflux is disclosed. The reflux wedge includes a wedge-shaped main body having a top side and a bottom side. In addition the reflux wedge includes a torso support section providing a substantially flat incline of approximately 25 to 45 degrees to receive and support the torso of the infant in a prone position. The torso support section is located on the top side of the wedge-shaped main body. The reflux wedge also includes a head support section adjoining the torso support section for receiving and supporting the head of the infant. An arch runs down a longitudinally aligned midline on the top side for receiving and supporting the infant and encouraging protraction of the shoulders. A crater is optionally located on the bottom side for receiving an infant in a supine position.

U.S. Patent Application Number 2005/0198739

Inventor: Robynne R. Elkin

Issued: Sep. 15, 2005

A reflux wedge for supporting an infant suffering from acid reflux is disclosed. The reflux wedge includes a wedge-shaped main body having a top side and a bottom side. In addition the reflux wedge includes a torso support section providing a substantially flat incline of approximately 25 to 45 degrees to receive and support the torso of the infant in a prone position. The torso support section is located on the top side of the wedge-shaped main body. The reflux wedge also includes a head support section adjoining the torso support section for receiving and supporting the head of the infant. An arch runs down a longitudinally aligned midline on the top side for receiving and supporting the infant and encouraging protraction of the shoulders. A crater is optionally located on the bottom side for receiving an infant in a supine position.

U.S. Pat. No. 7,003,831

Inventor: Elizabeth Goutevenier-Reyher

Issued: Feb. 28, 2006

A pillow is disclosed for securely maintaining a user at a predetermined angle from a flat surface. The pillow includes an angled member having a triangular shape. The pillow further includes a securing member and means for connecting the securing member to the angled member at a first apex thereof. Upon connecting the securing member to the angled member, a user is positioned against the angled member and is secured thereto by the securing member and the user is maintained at the predetermined angle.

International Patent Publication Number WO95/17118

Inventor: Karolen C. Bowman

Issued: Jun. 29, 1995

An infant reflux restraint apparatus, according to the present invention, preferably has a wedge shaped support member for readily positioning an infant on a support surface to thereby support an infant in a reclined position. A pair of side strips are secured to the wedge shaped support member and are positioned on an upper surface thereof. The pair of side strips are spaced apart in a generally parallel relationship and a sufficient amount so that an infant can be positioned therebetween. Each of the pair of side strips also longitudinally extends along adjacent respective sides of the infant. The apparatus further preferably has a head support member connected to the wedge shaped support member and positioned on an upper medial portion of the upper surface thereof for supporting the infant's head when reclined thereon. A reflux sling member detachably connects to the pair of side strips secured to the wedge shaped support member and is positionally longitudinally aligned with the head support member for positioning the lower torso of the infant therein when reclined on the wedge shaped support member.

Great Britain Patent Number GB2227930

Inventor: Erdinc Aziz

Issued: Aug. 15, 1990

A baby seat or recliner has a wedge-shaped main body, composed by fabric-covered sponge rubber, and a quilted or padded flange forwardly thereof, and side walls. Configured side straps meet at 8/8a and also fix strap thereat. Tabs resemble eyes. The whole is a simulacrum of a large toy frog, useful as a seat for small babies.

While these infant bedding units may be suitable for the purposes for which they were designed, they would not be as suitable for the purposes of the present invention, as hereinafter described.

SUMMARY OF THE PRESENT INVENTION

A primary object of the present invention is to provide a bedding arrangement for an infant having a removable head ring pillow with a cover for holding an infant's head in an elevated stable configuration.

Another object of the present invention is to provide a bedding arrangement for an infant comprising an angled pillow with a cover and cloth wrap for comfortably holding an infant at an angle of approximately 20 to 40 degrees.

Yet another object of the present invention is to provide a bedding arrangement for an infant having a removable head pillow that attaches to an angled pillow to be used cooperatively to bed an infant in an elevated and comfortable arrangement.

Still yet another object of the present invention is to provide a bedding arrangement for an infant having a removable sleeping bag arrangement that easily attaches to the associated angled pillow to provide additional comfort to an infant.

Another object of the present invention is to provide a bedding arrangement for an infant having an angled pillow having multiple accessories attachable via hook and loop fasteners fasteners.

Yet another object of the present invention is to provide a bedding arrangement for an infant capable of holding an infant at an inclined angle, to reduce acid reflux and respiratory pressure on a sleeping infant.

Additional objects of the present invention will appear as the description proceeds.

The present invention overcomes the shortcomings of the prior art by providing a bedding arrangement for an infant capable of holding an infant at an inclined angle, to reduce acid reflux and respiratory pressure on a sleeping infant comprising an angled pillow with a cover and cloth wrap that may be utilized as a sleeping bag or blanket along with a removable head ring pillow that all work together to comfortably hold an infant at a 20 to 40 degree incline.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing figures in which.

DESCRIPTION OF THE REFERENCED NUMERALS

Figure 1:
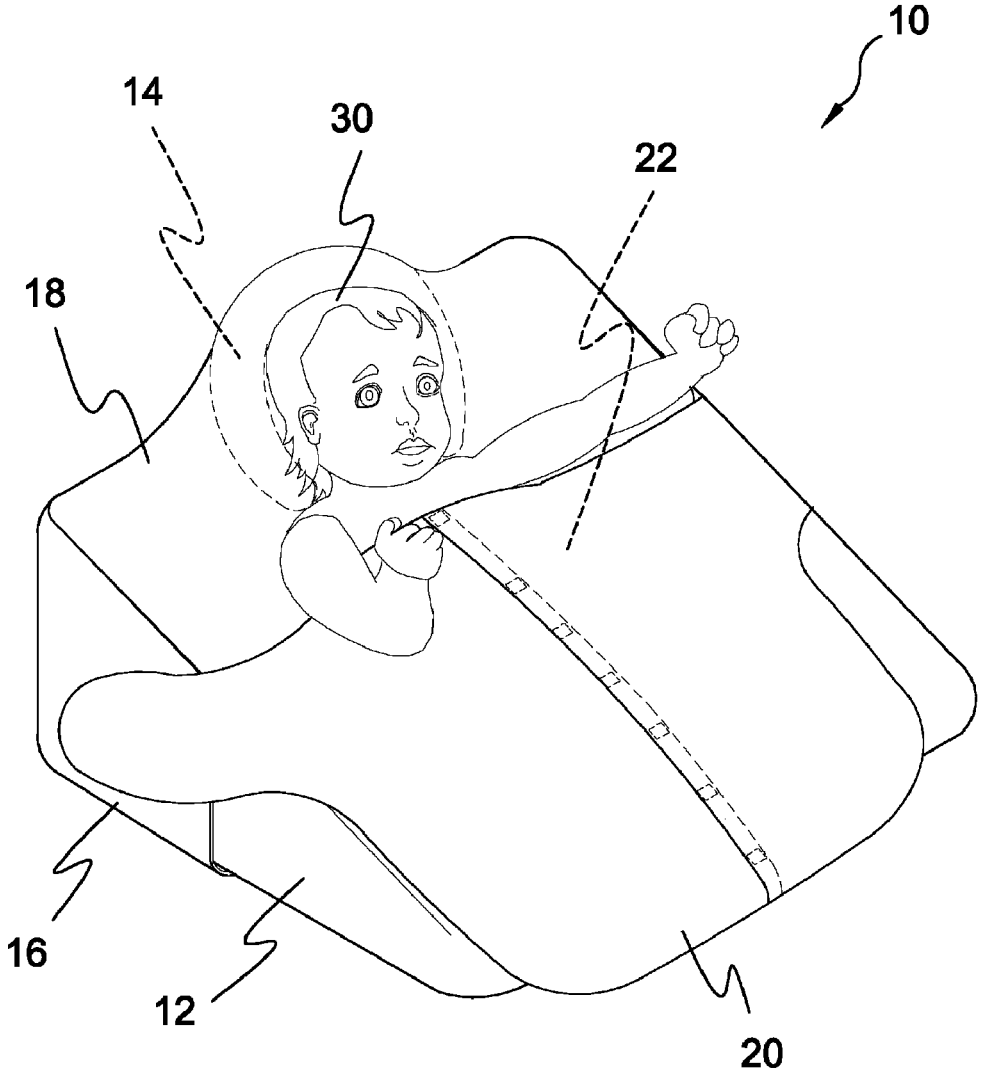
FIG. 1 is an illustrative view of the present invention in use.

Turning now descriptively to the drawings, in which similar reference characters denote similar elements throughout the several views, the figures illustrate the Infant Headrest and Angular Support Pillow of the present invention. With regard to the reference numerals used, the following numbering is used throughout the various drawing figures.

10 Infant Headrest and Angular Support Pillow of the present invention
12 angular pillow
14 head ring pillow
16 angular pillow cover
18 removable head ring cover
20 removable sleeping bag/blanket
22 cloth wrap
24 strap and ring securing member
26 hook and loop fastener element
28 side cut of 22
30 infant
32 strap of 24
34 ring of 24

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. An angular pillow 12 holds an infant 30 in a secured position and has a removable headring pillow 14 and removable head ring cover 18 that attaches to the angular pillow 12 by means of hook and loop fasteners with a removable/washable angled pillow cover 16. A sleeping bag/blanket 20 is provided and attaches to the lower portion of the headring 14, also by means of hook and loop fasteners and is secured in an open or closed position by means of hook and loop fasteners. Hook and loop strips attached cloth wrap 22 in which a baby 30 is placed upon said pillow 14 and wrapped in a slightly angled position (20° to 40°). The infant 30 is then wrapped about the waist with the attached cloth wrap 22 having hook and loop fasteners to secure the infant 30 to said pillow 12. Crib attachments are provided to secure the device to a child's crib. The infant 30 can then rest or digest after eating without suffering from acid reflux or flowing back of foods. Also, the infant 30 can rest more comfortably when suffering from upper respiratory, head and sinus congestion.

Figure 2:
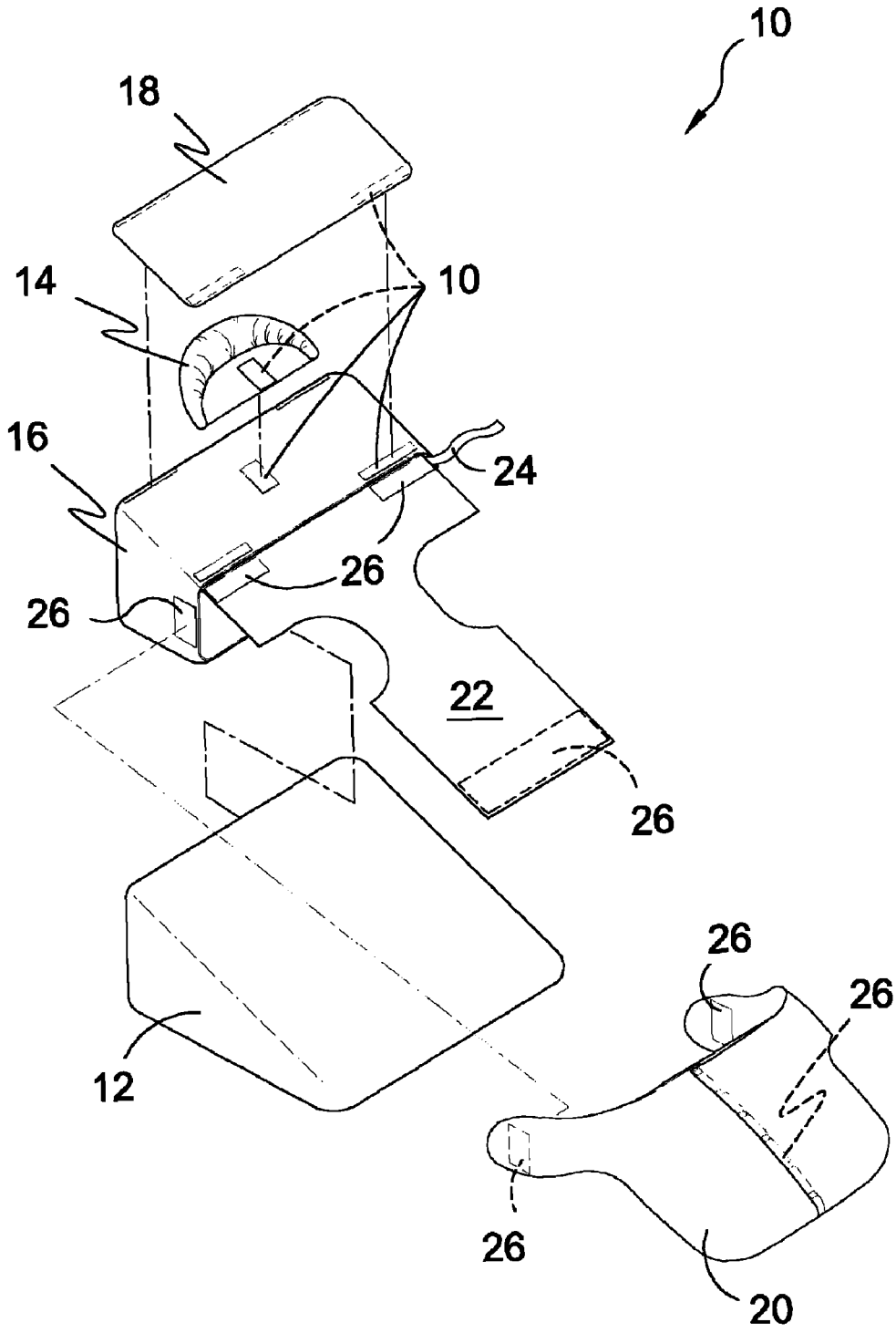
FIG. 2 is an exploded view of the present invention.

FIG. 2 is an exploded view of the present invention 10. Shown is the angular pillow 12 of the present invention 10 having an angled pillow cover 16 with a cloth wrap 22 integrally incorporated therewith having strap and ring securing members 24 to further secure a child in use. A removable head ring pillow 14 is provided, attachable to the angular pillow cover 16 by means of hook and loop fasteners 26 with a head ring pillow cover 18 that is attached over the head ring pillow 14, and fastened to the angular pillow cover 16 by means of hook and loop fasteners 26. In addition, a removable sleeping bag/blanket 20 is provided, attachable to the angular pillow cover 16 by means of hook and loop fasteners 26. The sleeping bag/blanket 20 has hook and loop fasteners 26 for wrap closure.

Figure 3:
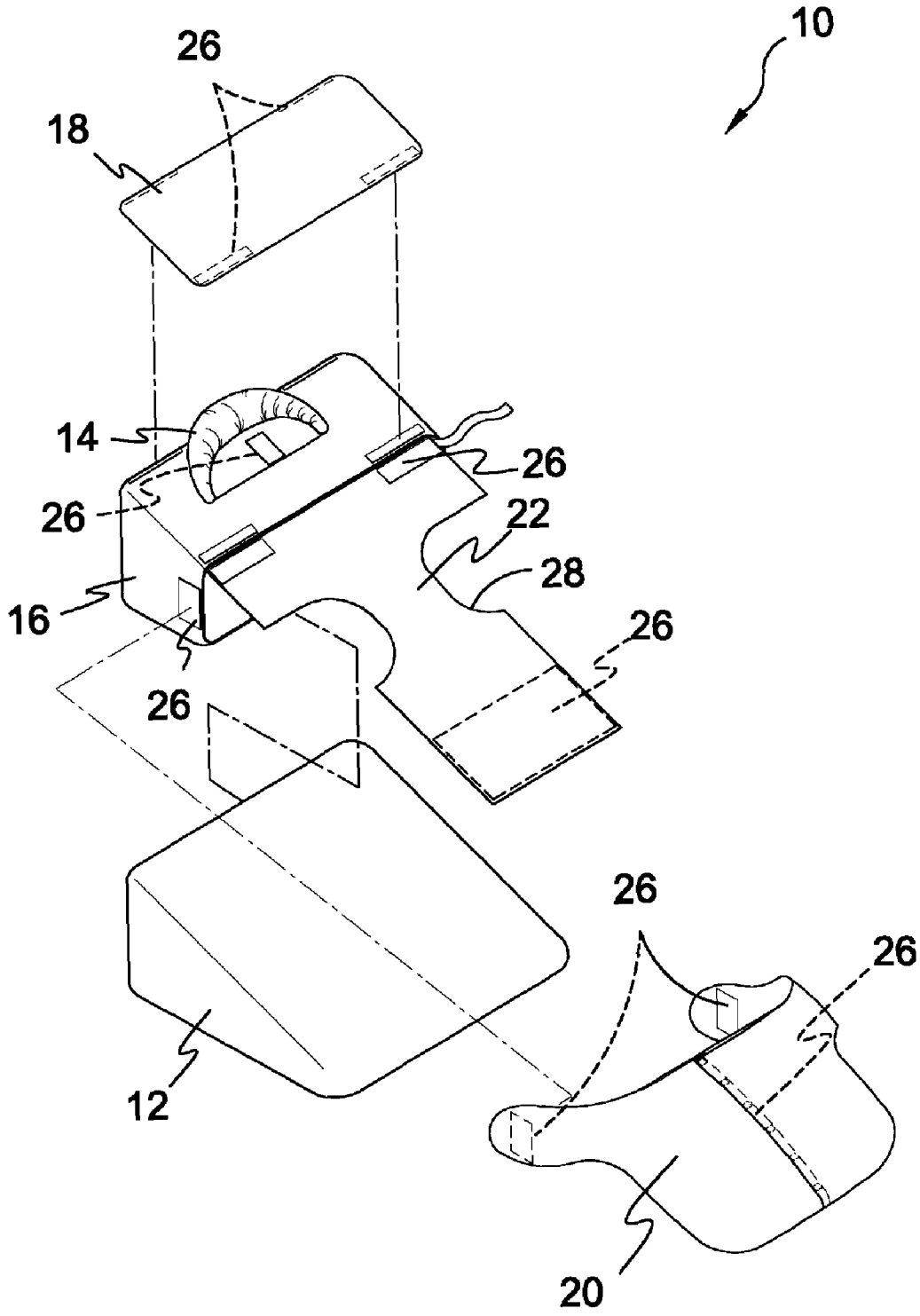
FIG. 3 is a partially exploded view of the present invention having a pillow in an attached position.

FIG. 3 is a partially exploded view of the present invention 10 having a pillow 12 in an attached position. Shown is the angular pillow 12 of the present invention 10 having a removable headring 14 attachable to the angular pillow cover 16 with the angled pillow cover 16 by means of hook and loop fasteners 26, a cloth wrap 22 with side cuts 28, and a removable sleeping bag/blanket 20.

Figure 4:
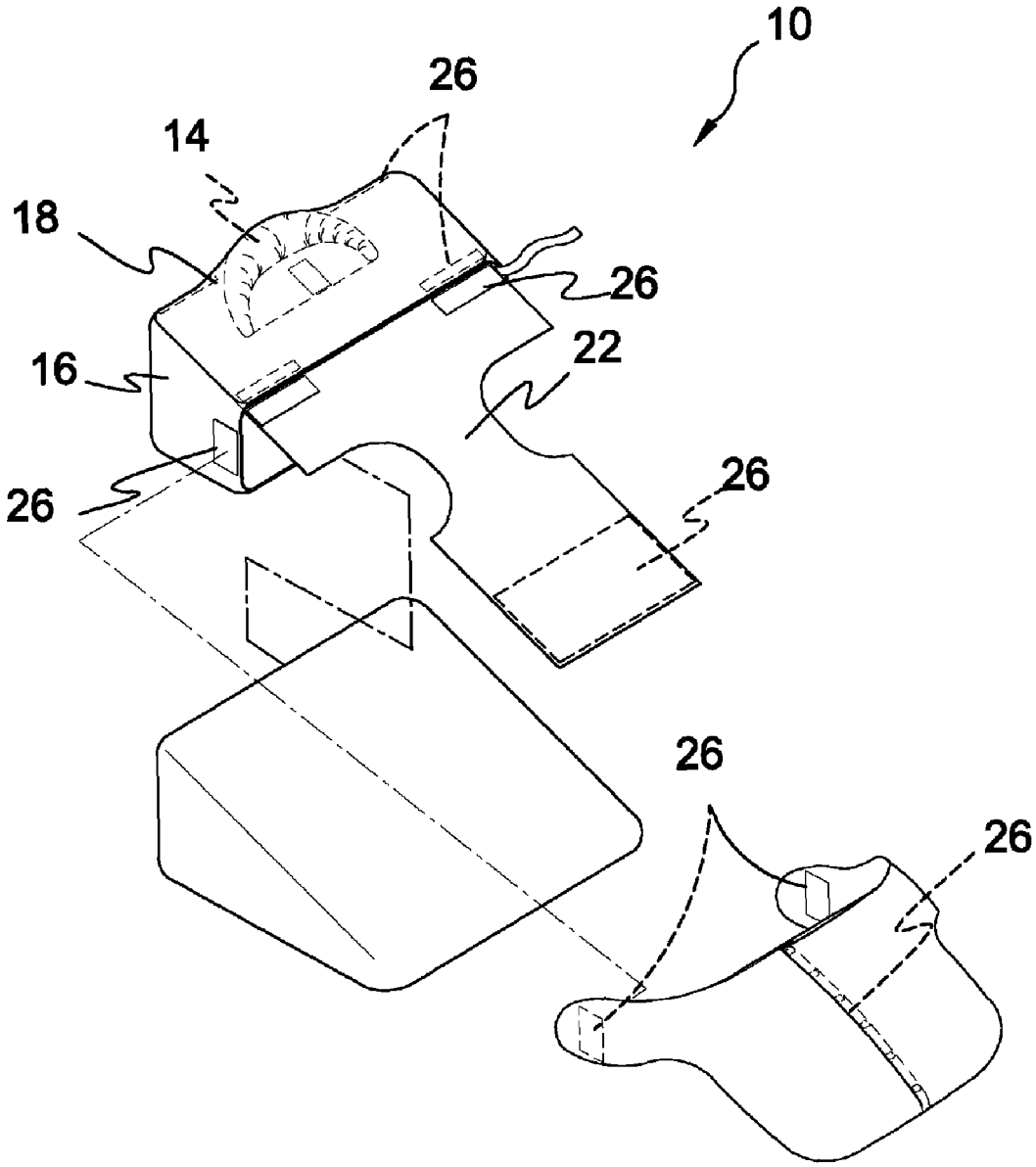
FIG. 4 is partially exploded view of the present invention having a top pillow cover attached.

FIG. 4 is partially exploded view of the present invention 10 having a top pillow cover attached. Shown is the removable head ring cover 18 and head ring 14 secured to the angled pillow cover 16 by means of hook and loop fasteners 26. The cloth wrap 22 is also secured to the pillow cover 16 with hook and loop fasteners 26.

Figure 5:
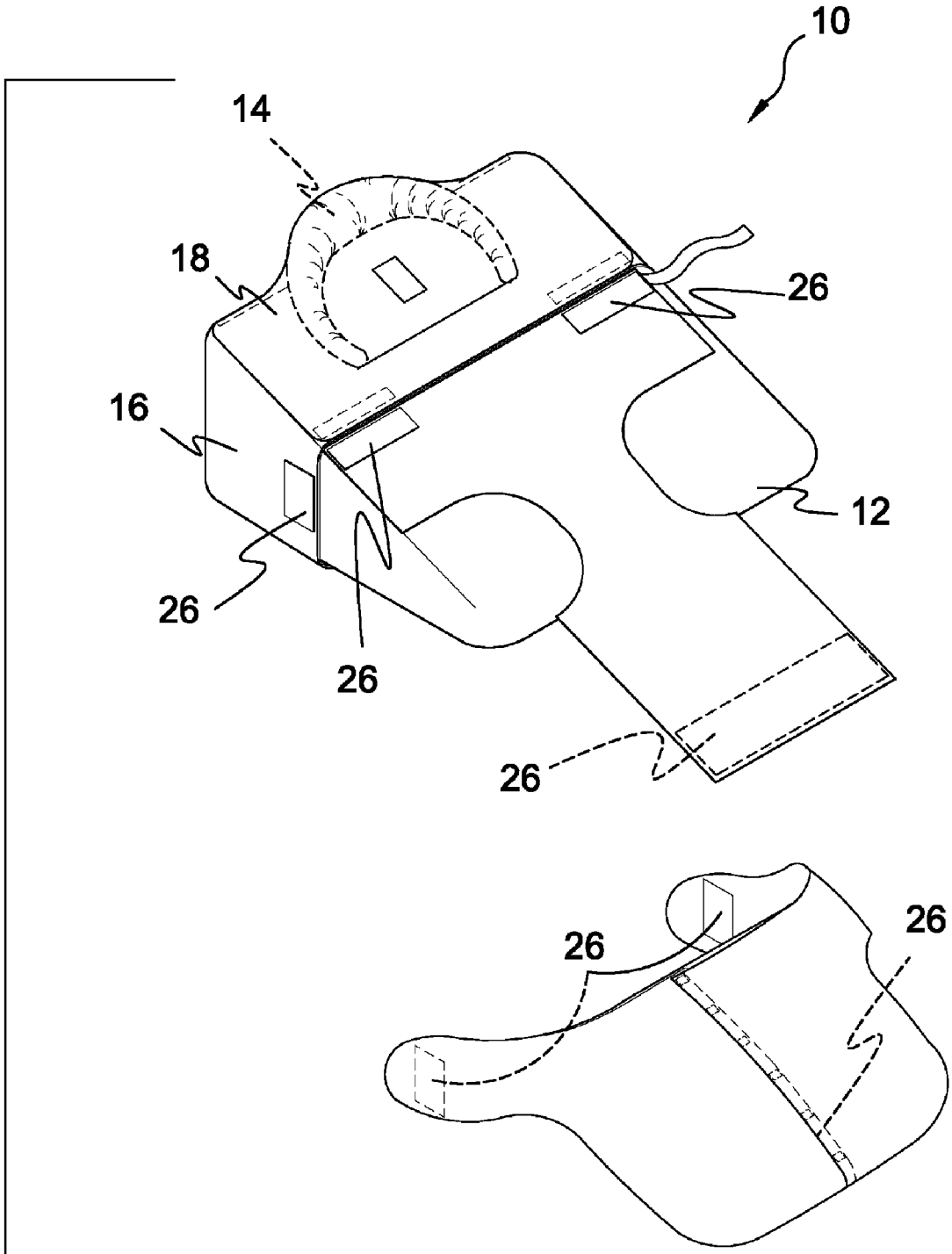
FIG. 5 is a partially exploded view of the present invention having an angular pillow cover attached to the angular pillow.

FIG. 5 is a partially exploded view of the present invention 10 having an angular pillow cover 16 attached to the angular pillow 12. Shown is angular pillow cover 16 with associated head ring 14 and head ring cover 18 secured to the angular pillow 12 with hook and loop fasteners 26.

Figure 6:
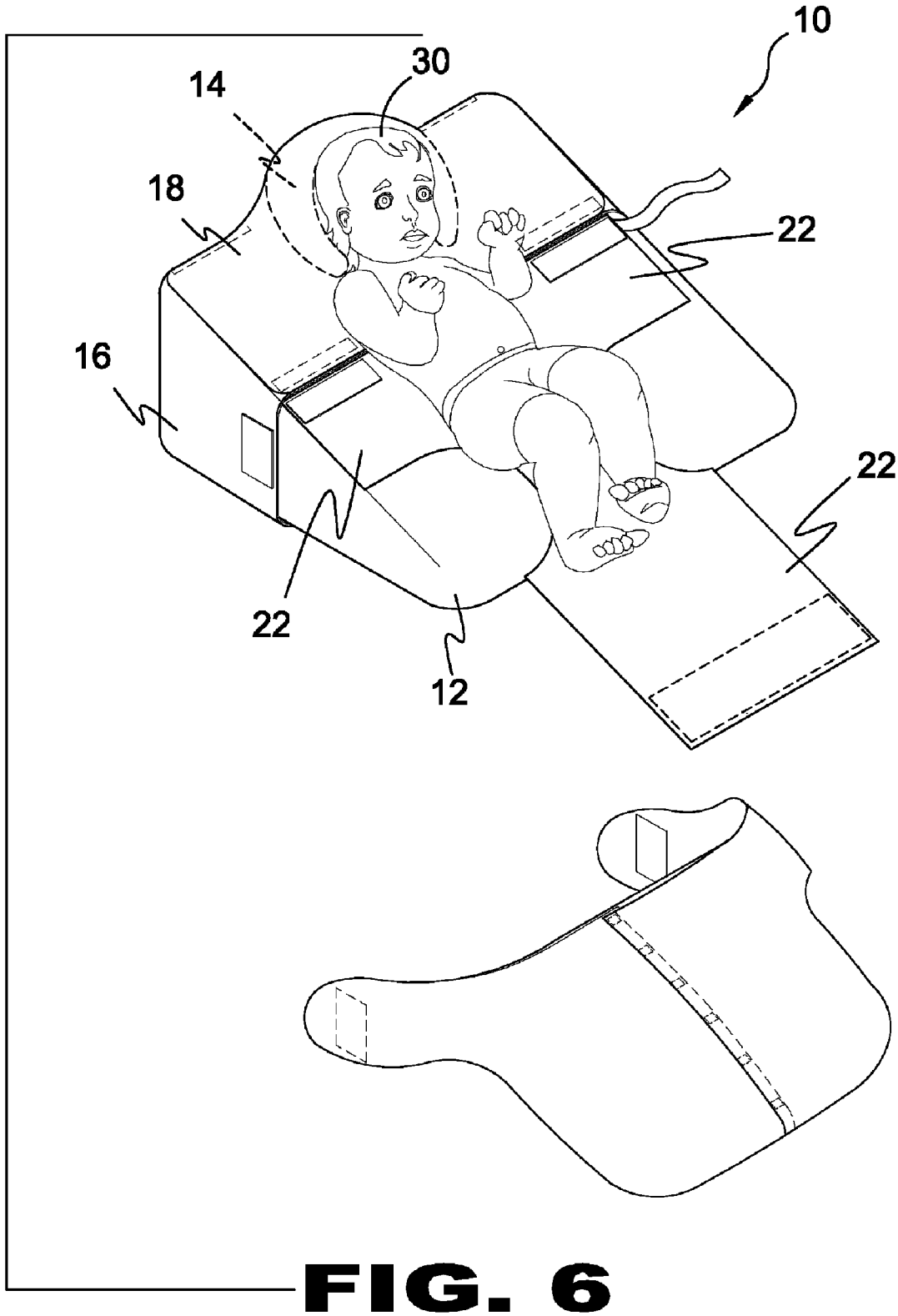
FIG. 6 is a partially exploded view of the present invention.

FIG. 6 is a partially exploded view of the present invention 10. Shown is the infant 30 placed on the cloth wrap 22, angled pillow cover 16 and removable head ring cover 18 overlaying the angled pillow 12 and head ring 14.

Figure 7:
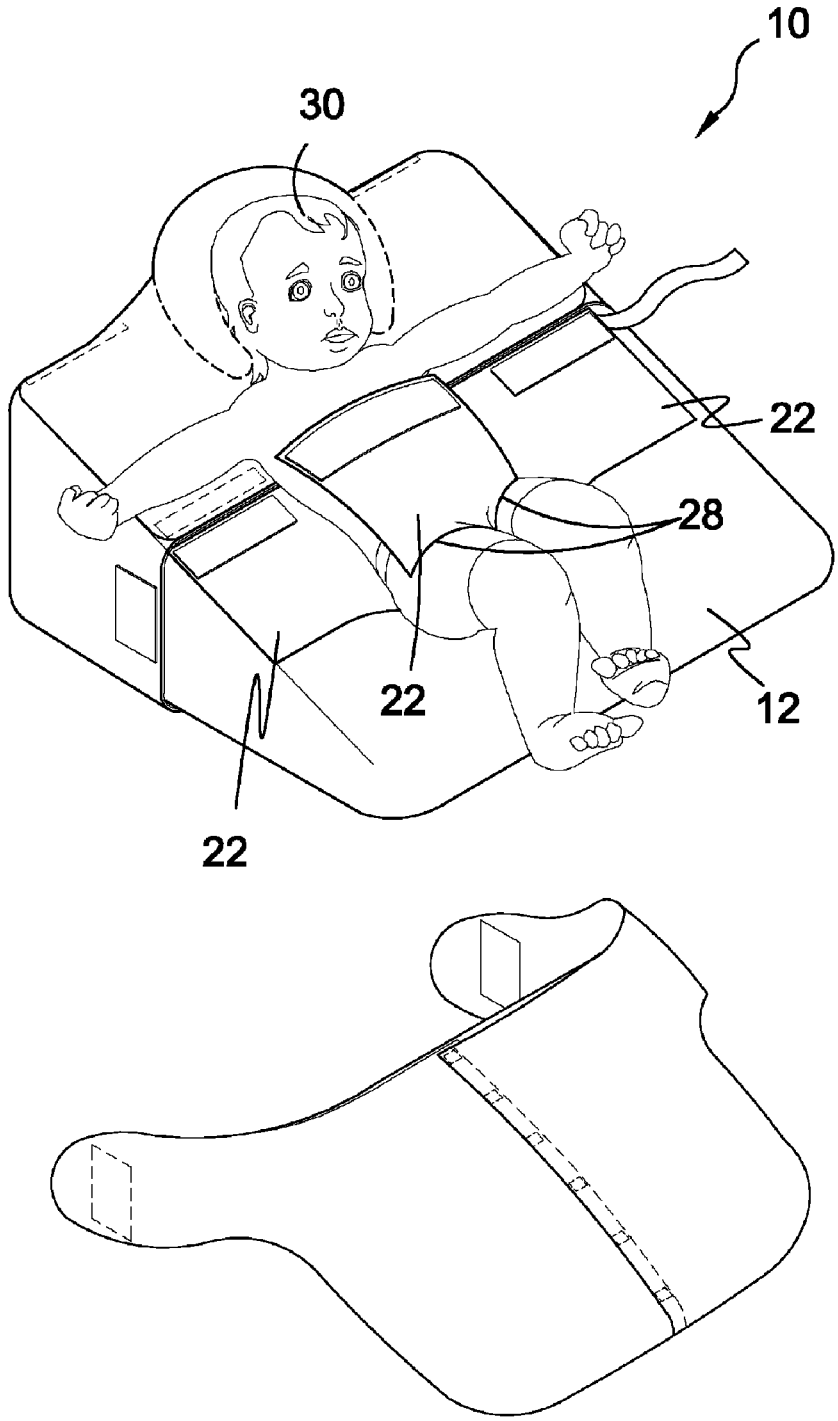
FIG. 7 is a partially exploded view of the present invention.

FIG. 7 is a partially exploded view of the present invention 10. Shown is the infant 30 positioned on the angular pillow 12 with the cloth wrap 22 folded between the legs to cover the torso. The side cuts 28 of the cloth wrap 22 provide comfort to the infant 30 during usage.

Figure 8:
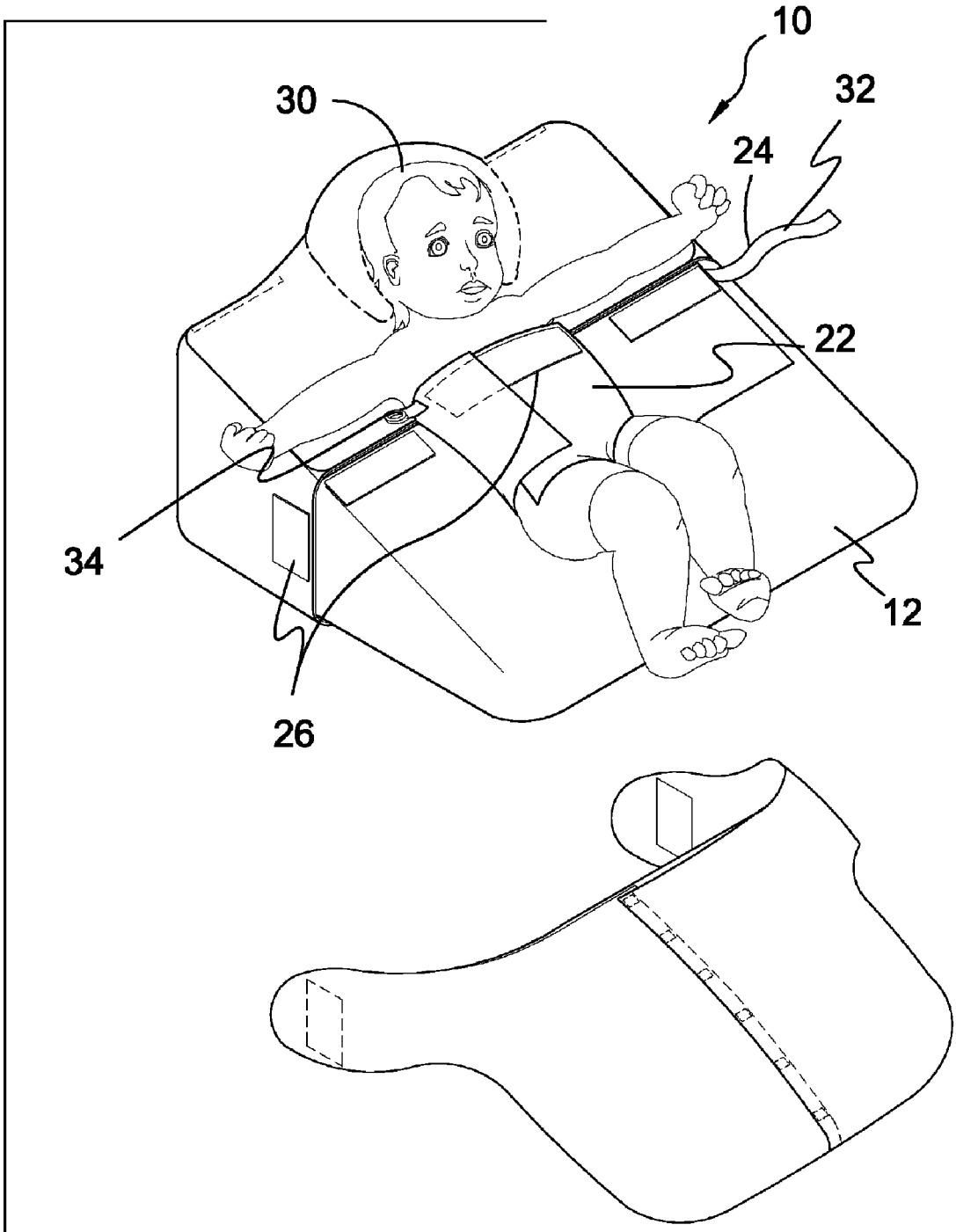
FIG. 8 is a partially exploded view of the present invention.

FIG. 8 is a partially exploded view of the present invention 10. Shown is the angular pillow 12 of the present invention 10 having an infant 30 secured thereto by the cloth wrap 22 hook and loop fasteners 26 and ready to further, secure by inserting the strap 32 of the strap and ring securing member 24 into the corresponding ring 34.

Figure 9:
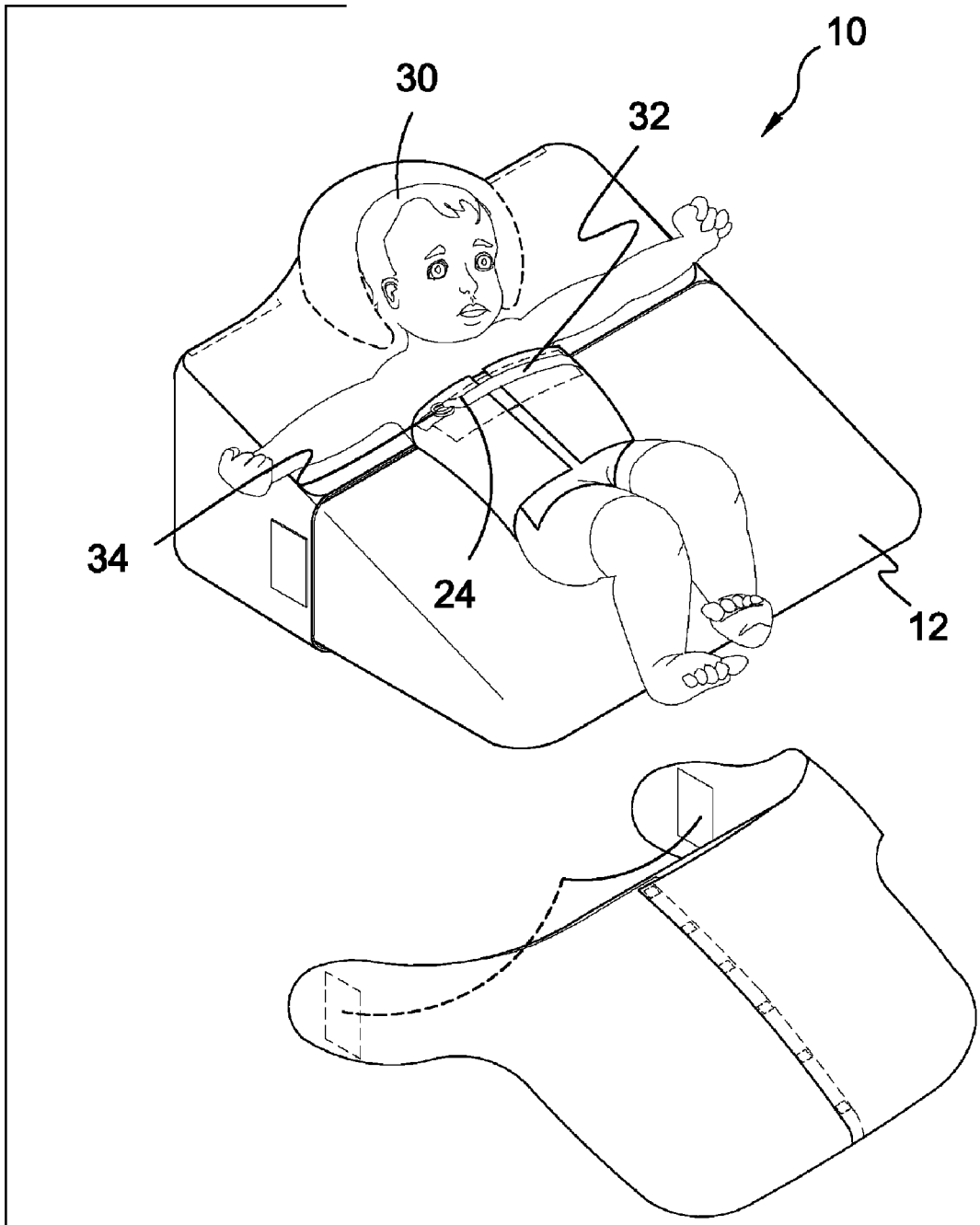
FIG. 9 is a partially exploded view of the present invention.

FIG. 9 is a partially exploded view of the present invention 10. Shown is the infant 30 further secured to the angular pillow 12 with the strap and ring fastening member 24 having the strap 32 looped through the corresponding ring 34.

Figure 10:
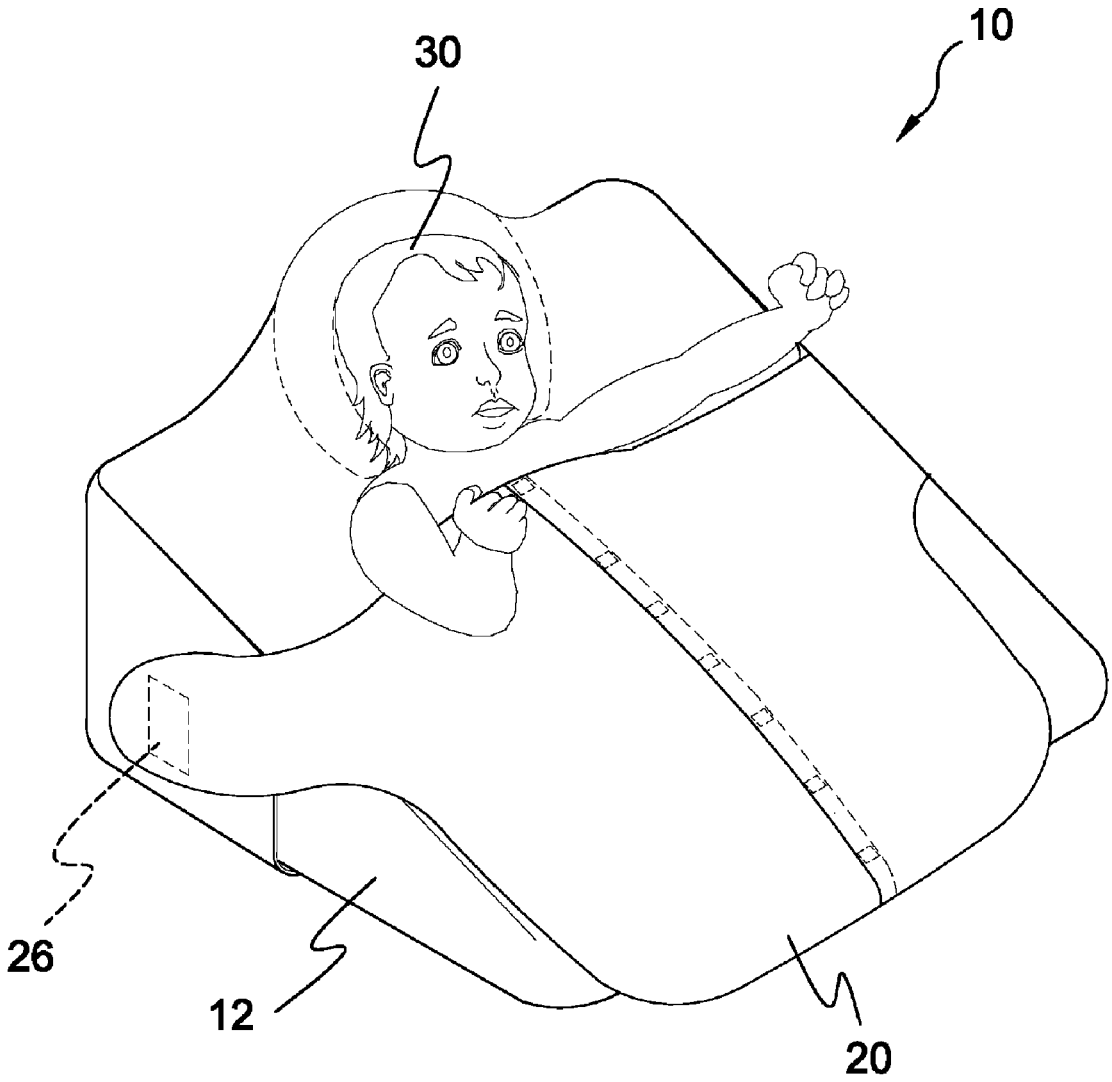
FIG. 10 is an assembled view of the present invention with a child in place.

FIG. 10 is an assembled view of the present invention with child in place. Shown is the infant 30 secured to the angular pillow 12 and enclosed by the removable sleeping bag/blanket 20 by hook and loop Velcro strips 26.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. An infant bedding system comprising:

a) a generally wedge shaped angular pillow having a thick end and a thin end;

b) an angled pillow cover enclosing only the thick end of said pillow, said angled pillow cover having a top member and an opposed bottom member, an end member joining said top and bottom members, and two angled side members;

c) a semicircular headring pillow removably mounted on said pillow cover with a fastener;

d) a cover over said headring pillow further securing said headring pillow to said angled pillow cover, said cover extending over and beyond said head ring and having fasteners securing said cover to said top member of said angled pillow cover;

e) a cloth wrap adapted to wrap around an infant;

f) said cloth wrap having an edge removably attached to a leading edge of said angled pillow cover; and g) hook and loop fasteners for securing a trailing edge of said cloth wrap around the waist of an infant, said cloth wrap having side cuts to accommodate legs of said baby.

2. An infant bedding system according to claim 1, wherein said angular pillow and said angled pillow cover together form a generally wedge shaped structure having an angle of between about 20° to about 40°.

3. An infant bedding system according to claim 2, said fastener securing said headring pillow to said angled pillow cover is a hook and loop fastener.

4. An infant bedding system according to claim 3, wherein hook and loop fasteners removably attach said cloth wrap to said angled pillow cover.

5. An infant bedding system according to claim 4, wherein straps and rings and hook and loop fasteners secure said cloth wrap around the waist of an infant.

6. An infant bedding system according to claim 5, wherein the fasteners securing said cover over said headring are hook and loop fasteners.

7. An infant bedding system according to claim 6, further comprising fasteners for removably affixing said infant bedding system to a crib.

8. An infant bedding system according to claim 6, further comprising an infant sleeping bag, said infant sleeping bag is secured to the angled side members of said angled pillow cover with fasteners.

9. An infant bedding system according to claim 8, said fasteners securing said infant sleeping bag to said angled side members of said angled pillow cover are hook and loop fasteners.

10. A method for securing an infant at a gently angled upright position comprising the steps of:

a) providing an infant bedding system having a generally wedge shaped angular pillow; an angled pillow cover enclosing only a thick end of said angular pillow, said angled pillow cover having a top member and an opposed bottom member, an end member joining said top and bottom members, and two angled side members; a semicircular headring pillow; fasteners for removably attaching said hedring pillow to said angled pillow cover; a cloth wrap adapted to wrap around an infant; fasteners for removably attaching one edge of said cloth wrap to a leading edge of said angled pillow cover; and a cover over said headring pillow further securing said headring pillow to said angled pillow cover, said cover extending over and beyond said head ring and having a plurality of fasteners securing said cover to said top member of said angled pillow cover;

b) placing an infant on said infant bedding system with the infant's head resting over said headring pillow and the infant's body overlying said cloth wrap;

c) folding said cloth wrap between the infant's legs to the infant's waist; and d) securing said cloth wrap around the waist of the infant.

11. A method for securing an infant at a gently angled upright position according to claim 10, wherein said angular pillow and said angled pillow cover together form a generally wedge shaped structure having an angle of between about 20° to about 40°.

12. A method for securing an infant at a gently angled upright position according to claim 11, wherein the fasteners removably attaching said headring pillow to said angled pillow cover are hook and loop fasteners.

13. A method for securing an infant at a gently angled upright position according to claim 12, wherein hook and loop fasteners are employed for removably attaching said cloth wrap to said angled pillow cover.

14. A method for securing an infant at a gently angled upright position according to claim 13, wherein said cloth wrap comprises a generally rectangular cloth having sidecuts adapted to wrap around an infant's legs.

15. A method for securing an infant at a gently angled upright position according to claim 14, wherein strap and ring securing members are employed for securing said cloth wrap around the waist of an infant.

16. A method for securing an infant at a gently angled upright position according to claim 10, wherein the fasteners securing the cover over said headring are hook and look fasteners.

17. A method for securing an infant at a gently angled upright position according to claim 16, further comprising means for removably affixing said infant bedding system to a crib.

18. A method for securing an infant at a gently angled upright position according to claim 17, further comprising an infant sleeping bag.

19. A method for securing an infant at a gently angled upright position according to claim 18, wherein said infant sleeping bag is attached to said angled side members of said angled pillow cover.

20. A method for securing an infant at a gently angled upright position according to claim 19, further comprising hook and loop fasteners for attaching said infant sleeping bag to said headring.

21. A method for securing an infant at a gently angled upright position according to claim 20, further comprising securing an infant within said sleeping bag.

22. A method for securing an infant at a gently angled upright position according to claim 17, wherein said means for removably affixing said infant bedding system to a crib comprises hook and loop fasteners.

* * * * *